US005159203A

United States Patent [19]

Gallenschütz et al.

[11] Patent Number: 5,159,203

[45] Date of Patent: Oct. 27, 1992

[54] SAFETY CIRCUIT FOR FLYWHEEL MASSES OR MACHINE PARTS THAT ARE DRIVEN BY ELECTRIC MOTOR AND CAN BE BRAKED OR ARRESTED ELECTRICALLY

[75] Inventors: Thomas Gallenschütz, Bühl/Baden; Gerhard Oberle, Baden/Baden; Roland Ebert, Achern, all of Fed. Rep. of Germany

[73] Assignee: Gallenschütz Metallbau GmbH, Bühl/Baden, Fed. Rep. of Germany

[21] Appl. No.: 599,003

[22] Filed: Oct. 17, 1990

[30] Foreign Application Priority Data

Oct. 18, 1989 [DE] Fed. Rep. of Germany ..... 3934662

[51] Int. Cl.[5] ..... H01H 35/00; E05F 15/02; E05F 15/18

[52] U.S. Cl. ..... 307/116; 49/27; 49/29; 49/42; 318/467

[58] Field of Search ..... 49/35, 40, 42, 26, 27, 49/29; 307/328, 116, 119; 318/266, 286, 466–469

[56] References Cited

U.S. PATENT DOCUMENTS

| | | | |
|---|---|---|---|
| 3,678,623 | 7/1972 | Jenkins | 318/466 |
| 4,289,995 | 9/1981 | Sorber et al. | 318/266 |
| 4,534,131 | 8/1985 | Blackston et al. | 49/42 |
| 4,627,193 | 12/1986 | Schwarz | 49/42 |

*Primary Examiner*—A. D. Pellinen
*Assistant Examiner*—Richard Elms
*Attorney, Agent, or Firm*—McGlew & Tuttle

[57] ABSTRACT

In safety circuits for braking or arresting devices (7) of flywheel masses or machine parts, especially a revolving door, which are driven by electric motor and can be switched on electrically, in which at least one of two edges moving toward each other is provided with a pressure-sensitive electrical switching member (3) for generating interference signals. Interference signals generated during a disturbance are sent to an electronic control unit (1) and are used, by an electronic switch (8), to switch off the drive motor (10) and/or to switch on a braking or arresting device (7). The movement of the part provided with the movable edge or element is stopped even when the electrical switch (8) of the control unit (1) does not respond correctly in the presence of an interference signal. The reliability of the safety circuit is continuously checked. An electronic switching unit (2), which interrupts the continuous excitation of a safety relay (4) having at least three relay contact switches (a, b, c) and at least one closing contact (a, b, or c), is connected before the electronic control unit (1). The relay contact switches (a, b, c) switch the circuits (9, 6) of the drive motor (10) and of the braking or arresting device (7), as well as a control circuit (11).

8 Claims, 1 Drawing Sheet

SAFETY CIRCUIT FOR FLYWHEEL MASSES OR MACHINE PARTS THAT ARE DRIVEN BY ELECTRIC MOTOR AND CAN BE BRAKED OR ARRESTED ELECTRICALLY

FIELD OF THE INVENTION

The present invention pertains to a safety circuit for braking or arresting devices of flywheel masses or machine parts, especially revolving doors, which devices are driven by an electric motor and can be switched on electrically. The invention relates more particularly to such an arrangement in which at least one of two edges moving toward each other is provided with a contact-sensitive or pressure-sensitive electrical switching member or the like, whose interference signals, which are generated in case of a disturbance, are sent to an electronic control unit, especially a programmable microprocessor, and are used by this electronic control unit or microprocessor or by means of an electronic switch for switching off the drive motor and/or to switch on the braking or arresting device.

BACKGROUND OF THE INVENTION

Such safety circuits are used, in general, to ensure that people or objects who or which come between two edges moving toward each other and are caught by them (such as between a revolving door and its associated wall or stand body) will not be injured or damaged. The principal task of such an arrangement being to stop the part on which the moving edge is located as soon as the contact- sensitive or pressure-sensitive switching member sends a corresponding interference signal. The motor-driven part can be stopped in two different ways, namely, by switching off the drive motor and simultaneously switching on a braking or arresting device, or by switching on the electronic braking or arresting device. The braking torque that must be applied in the latter case must be high enough so that it cannot be overcome by the drive torque of the motor and the moment of inertia of the moving mass. However, this condition is also important for the case in which the motor drive is not switched off due to any switching disorder.

Since increased safety against the risk of injury is required for people, conventional safety circuits, which are only singly secured, are not sufficient for such cases. This is due to the fact that it can never be ruled out that failure of the unit controlling the switching on of the braking or arresting device can also occur simultaneously with a failure of the unit controlling the switching off of the drive motor.

SUMMARY AND OBJECTS OF THE INVENTION

It is an object of the present invention to improve a safety circuit of the type mentioned in the introduction such that the movement of the part provided with the movable edge, especially of a machine part or a revolving door, is stopped even when the electronic switch of the control unit or the microprocessor fails to interrupt the circuit of the drive motor in the presence of an interference signal and/or the control unit or the microprocessor fails to switch on the braking or arresting device. In addition, the reliability of the improved safety circuit shall be able to be continuously checked by the microprocessor.

This task is accomplished according to the present invention by an electronic switching unit, which receives the actually existing interference signals of the switching member and forwards them to the control unit connected in front of the electronic control unit, wherein this electronic control unit interrupts—coinciding in time with the duration of the interference signals and independently of the control unit—the continuous excitation of a safety relay. This safety relay has at least one closing contact among at least three relay contact switches, which can be actuated only jointly and have restricted or partially restricted guidance. One closing contact is connected in series with the electronic switch of the control unit in the circuit of the drive motor, one of the other two relay contact switches is located in a secondary circuit of the braking or arresting device, which secondary circuit is provided with a time switch. A third relay contact switch is located in a control circuit of the control unit in order to confirm the correct mode of operation of the safety relay or the control unit in the form of a confirmation signal.

The additional relay contact switches in the circuit of the drive motor and in a secondary circuit of the braking or arresting device and their control by a switching unit that is independent of the control unit or the microprocessor ensures that the moving flywheel mass will be stopped as soon as an interference signal is present on the switching unit. This stopping occurs even in the case of partial or total failure of the control part of the control unit or microprocessor that controls the electronic switch of the motor circuit and the switching on of the braking or arresting device. The selected mode of operation of the safety relay, namely, the continuous energization, also ensures that the motor circuit will also be interrupted and the braking or arresting device will be switched on in the case of failure of the switching unit. Consequently, even this creates a certain self-control. However, the orderly operation of the safety relay is also reported to the control unit or the microprocessor by the additional relay contact switch located in the control circuit, so that the ability of the safety relay to function and its two working contacts are continuously monitored.

One aspect of the invention concerns different relay contact switch combinations and an embodiment of the invention offers an additional safety factor inasmuch as the ability to function of the safety relay and its contacts can be checked at shorter intervals even when no interference signal is generated over rather long time periods.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
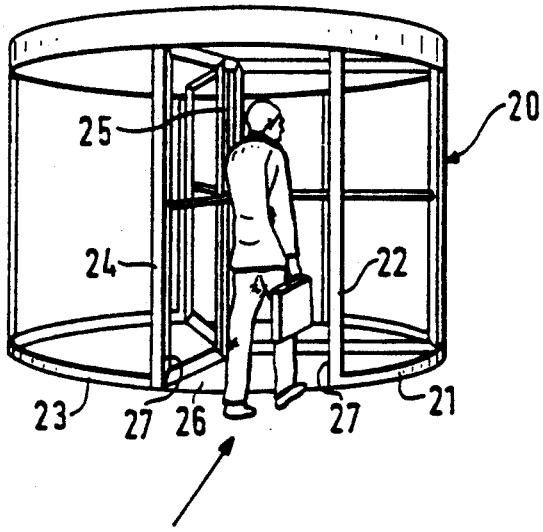
FIG. 1 is a simplified perspective front view of a passage for people with a revolving door; and, FIGS. 2, 3 and 4 show simplified block diagrams of safety circuits according to the invention with three different relay contact switch combinations.

Revolving door installations usually consist of a cylindrical stand body 20 with two shell-like, stationary sectors 21 and 23. Between these sectors 21 and 23 one access opening 26 and one exit opening 26, through which persons are able to enter and exit, are provided on the outside and the inside of a building or the like. So-called safety strips 27, which are provided with electrical switching members 3 are provided which respond to pressure. These switching members 3 are arranged on the vertical limiting beams 22 and 24 of these access and exit openings 26. These switching members 3 generate an interference signal when, e.g., an object enters or is jammed between the outer edge of a door wing and one of the limiting beams during the rotation of the three-winged revolving door 25, that is rotatable around its center and is driven by a motor 10. To prevent this jammed object or body part from being damaged, it must be ensured that the interference signal generated by one of the switching members 3 immediately leads to stopping of the door. Because such revolving doors usually have an appreciable mass, which may have a considerable kinetic energy during the rotary movement, switching off the drive motor is usually insufficient in such cases. It is necessary to provide an electrically energizable braking or arresting device with delayed action, which is able to absorb the intrinsic kinetic energy (flywheel effect) of the rotating revolving door, i.e., to instantaneously stop the revolving door. For safety reasons, the braking or arresting force of the braking or arresting device must be great enough so that it can overcome the drive torque of the drive motor 10. The braking or arresting device must consequently be able to stop the revolving door even when the drive motor is not switched off or is not switched off immediately in the case of a disturbance in the control, despite the interference signal.

Figure 2:
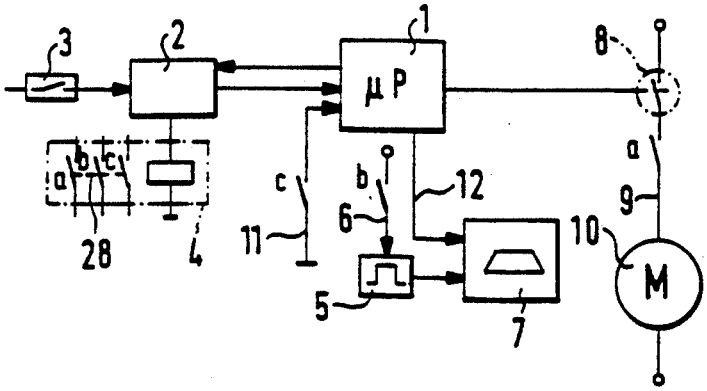
Figure 3:
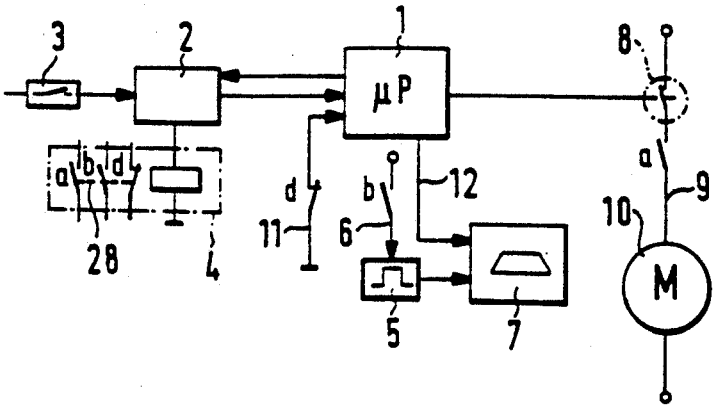
Figure 4:
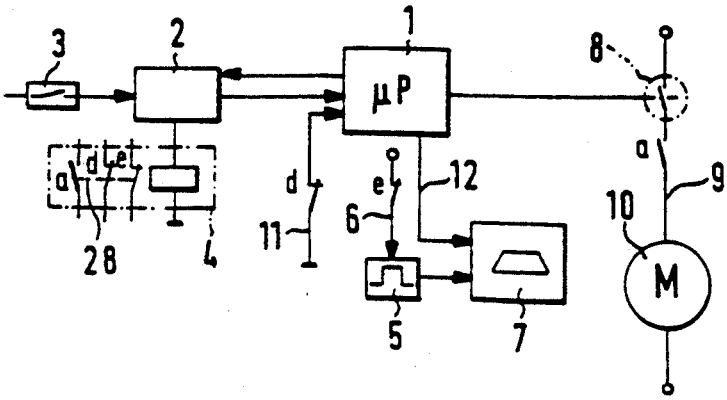

Such a braking or arresting device 7 is shown schematically in FIGS. 2 through 4.

To control such revolving doors 25, a microprocessor 1 is usually provided, which opens and closes the circuit 9 of the electric motor 10 by means of an electronic switch 8 and which also energizes the electrical braking or arresting device 7 via a control line 12.

To ensure that an object jammed between a door wing and a limiting beam 22 or 24 can again be freed after the drive motor 10 has been switched off and the revolving door 25 has been stopped by the electrical braking or arresting device 7, the electrical braking or arresting device 7 must again be switched off after a short time delay lasting, e.g., 2 sec, in order for the revolving door 25 to be able to be again rotated in the opposite direction. To do so, the microprocessor 1 is provided in its circuit of the electrical braking or arresting device 7 with a time switch which performs this task.

While the interference signals of the switching members 3 are sent directly to the microprocessor 1 in the switching devices of the type described so far, disturbances in the operation of the microprocessor 1, which develop upon the occurrence of such a malfunction, can lead to the drive motor 10 not being switched off and/or the electrical braking or arresting device not being switched on, a control unit 2 is connected before the microprocessor 1 in the safety circuit shown in FIGS. 2 through 4, and the control unit 2 transmits the interference signals of the switching member 3 to the microprocessor 1, and induces it to switch on the electrical braking or arresting device and to interrupt the motor circuit 9 by its electronic switch 8 and additionally controls a safety relay 4. The safety relay 4 is provided with at least three relay contact switches a, b, c or a, b, d, or a, d, e, which can be actuated only jointly and have restricted or partially restricted guidance. At least one of the relay contact switches is a closing contact a and is used to additionally switch off or interrupt the motor circuit 9. For this purpose, it is connected in series with the electronic switch 8 of the microprocessor 1 in the motor circuit 9. The second relay contact switch b or e is located in a secondary circuit 6 of the electrical braking or arresting device 7, which is additionally provided with a time switch 5, because it assumes the function of the above-mentioned time switch in the microprocessor 1 in the case of malfunction.

The third relay contact switch c or d is located in a control circuit 11 and is used to report the proper mode of operation of the safety relay 4 or of the switching unit 2 to the microprocessor in the form of a confirmation signal whenever an interference signal appears.

The safety relay 4 is operated with continuous excitation, so that it is switched off and released when an interference signal arrives in the switching unit 2. This mode of operation also ensures that a disturbance in the switching unit 2 or a malfunction in the safety relay 4 itself is reported to the microprocessor 1 when this leads to the release of the safety relay 4 without an interference signal being present. For the same reason, the safety strips 27 and their switching members 3 are also designed such that they act similarly to a break contact when the above-described disturbance occurs, i.e., a constant current is interrupted or reduced.

Safety relays with relay contact switches with restricted or partially restricted guidance have the property that their contact switches can be brought into the other switching position by means of an actuating web 28 only jointly. Restricted guidance means that no contacts of the opposite switching position may be closed as long as a contact is made in a given switching position.

Distinction is made between fully restricted guidance and partially restricted guidance.

Fully restricted guidance is defined as the state in which in the case of fusing together (nonbreaking) of any contact within a spring assembly, the fused contact determines the state of switching in the entire spring assembly. Since this fully synchronous state is guaranteed only in the case of 100% contact reliability, it cannot be guaranteed in practice.

Partially restricted guidance means that no closing contact may be closed in the case of a fused break contact and no break contact may be closed in the case of a fused closing contact.

Because 100% contact reliability can certainly never be achieved in practice, it may happen in the case of partially restricted guidance that even though no closing contact is closed in the case of a fused break contact and vice versa, another closing contact may open in the case of a fused closing contact or another break contact may open in the case of a fused break contact. However, such states cannot be reliably controlled and therefore cannot be used reliably in a safety circuit.

The safety circuits shown schematically in FIGS. 2 through 4 operate as follows:

As soon as the switching unit 2 receives an interference signal from the switching member 3, this signal is transmitted to the microprocessor 1, and the latter interrupts the motor circuit 9 via its electronic switch 8. The safety relay 4 is also switched off at the same time by the switching unit 2, so that all relay contact switches a, b, c or d and e jump into their respective opposite switching positions, i.e., the relay contact switches a, b and c open, while the relay contact switches d and e close the circuit at the same time. The relay contact switch a opens in the normal case, i.e., when the electronic switch 8 operates properly, because the mechanical relay contact switches are more sluggish than the electronic switch 8. The electrical braking and arresting device 7 is switched on approximately simultaneously by both the microprocessor 1 and the relay contact switches b or e in order to instantaneously stop the revolving door 25 that was previously driven by the motor.

The electrical braking or arresting device 7 is again switched off by the time switch 5 located in the microprocessor 1 or in the secondary circuit 6 after about 2 seconds.

The release of the safety relay 4 is reported by the relay contact switches c or d to the microprocessor 1. If this confirmation signal is not sent, the microprocessor 1 is able to prevent—by means of a corresponding test circuit or a corresponding test program—the drive motor 10 from being restarted or the revolving door from being used by switching on the electrical braking or arresting device.

The control circuit with the contact switches c and d is consequently used to monitor the ability to function of the so-called safety line, which represents the relay 4 with its relay contact switches a through e.

However, since it may happen that disturbances which induce an interference signal by the safety strips 27 occur only at long time intervals during the normal operation of a revolving door and the ability to function of this so-called safety line is not normally monitored during these time intervals, it is provided that the microprocessor 1 regularly sends testing impulses to the switching unit 2 at certain, clearly identifiable time intervals, and these testing impulses also bring about a release of the safety relay 4 in order to determine whether the safety relay 4 is still able to operate. When the relay contact switch c or d responds in such a case, the microprocessor 1 will again receive the confirmation signal. This confirmation signal will not be sent, with the consequence that the microprocessor 1 will put the unit out of operation, only when one of the three relay contact switches a, b, c or a, b, d or a, d, e is prevented from jumping over into the opposite switching position.

While the safety relay 4 is equipped with three closing contacts a, b, c in the embodiment according to FIG. 2, the safety relay 4 in the embodiment according to FIG. 3 is equipped with two closing contacts a and b and one break contact d, and the safety relay 4 in the embodiment according to FIG. 4 is equipped with only one closing contact a and two break contacts d and e. However, the closing contact a is connected in series with the electronic switch 8 of the motor circuit 9 in all cases.

Since it cannot be guaranteed that, e.g., the relay contact switch c will not open when the relay contact switch a is fused in the case of three relay contact switches a, b, c of the same type, because 100% contact reliability cannot be achieved despite fully or partially restricted guidance, the so- called safety line in itself cannot guarantee 100% reliability.

In contrast, in the embodiments according to FIGS. 3 and 4, in which the relay contact switch d located in the control circuit is designed as a break contact and always assumes the opposite switching position compared with the closing contact a, it can be guaranteed due to the partially restricted guidance that the relay contact switch d will not close and is consequently unable to send a confirmation signal for orderly operation to the microprocessor 1 when the relay contact switch a is fused, i.e., unable to open due to being defective.

This also applies to the embodiment according to FIG. 4, in which the relay contact switch e located in the secondary circuit 6 of the electrical braking and arresting device is also designed as a break contact.

While it cannot at least be fully ruled out in the case of the embodiment according to FIG. 3 that the closing contact b of the secondary circuit 6 of the electrical braking and arresting device will open in the case of fused closing contact a when the safety relay 4 is released, this possibility can be ruled out with certainty in the case of the partially restricted guidance according to FIG. 4, i.e., e is unable to close when a does not open.

For the above-mentioned reasons, the embodiment of the safety circuit shown in FIG. 3, in which the safety relay 4 is provided with two closing contacts a and b and one break contact d, should preferably be used when the break contact is placed into the control circuit 11 and the second closing contact b is placed into the secondary circuit of the electrical braking or arresting device 7. Even though the two embodiments according to FIGS. 2 and 4 can also be used, in principle, the optimal reliability of operation, which is achieved with the embodiment according to FIG. 3, is not guaranteed, because contact reliability never reaches 100% even in the case of fully restricted guidance of the relay contact switches.

Using simple means, the safety circuit according to the present invention not only improves the reliability of operation of the revolving door assembly to a high level of reliability, but it also ensures that the ability to operate the additional, so-called safety line itself can also be continuously monitored.

This safety switching device can be used for all applications where motor-driven flywheel masses must be stopped instantaneously on the appearance of an interference signal. Consequently, its application is not limited to revolving doors and automatic door and gate installations in general, but it can also be used for machines and machine parts.

While specific embodiments of the invention have been shown and described in detail to illustrate the application of the principles of the invention, it will be understood that the invention may be embodied otherwise without departing from such principles.

What is claimed is:

1. A safety circuit for braking a device driven by an electric motor, the device including an edge moving relative to another edge, comprising:

a contact sensitive or pressure sensitive electrical switching member for generating an interference signal upon sensing contact or pressure; electronic switching means connected to said motor for interrupting power to said motor; braking means for breaking said device; microprocessor control means for at least one of activating said electronic switching means and switching on said braking means; a safety relay including at least three relay contact switches having one closing contact which is normally closed, said contact switches being actuatable jointly, said closing contact being connected in series with said electronic switch and one of said contact switches being connected to form a secondary circuit of said braking means, said secondary circuit including a time switch element for switching off said braking means after a short time delay; safety control means for receiving said interference signal and forwarding said interference signal to said microprocessor control means and for interrupting a continuous excitation of said safety relay during a time period corresponding to the duration of said interference signal, independently of said microprocessor control means, said safety control means and one of said three relay contact switches forming a safety control circuit for confirming the operation of said safety relay or said safety control means.

2. A safety control circuit according to claim 1, wherein each of said three relay contacts is a closing contact.

3. A safety circuit according to claim wherein said relay contact forming said control circuit is a break contact which is normally open.

4. A safety circuit according to claim 3, wherein said relay contact forming said secondary circuit of said braking means is a break contact which is normally open.

5. A safety control circuit according to claim 3, wherein said at least three relay contact switches have partially restricted guidance wherein no closing contact may be closed if any of each of said three relay contact switches is a fused break contact and no break contact of any of each of said three relay contact switches may be closed in the case of any of said three relay contact switches being a fused closing contact.

6. A safety circuit according to claim 1, wherein said relay contact forming said control circuit is a break contact which is normally open and said relay contact forming said secondary circuit of said braking means is a closing contact.

7. A safety circuit according to claim 1, wherein said microprocessor control means, during an inactive period generates a testing signal corresponding to the interference signal generated by said switching means, said testing signal being sent to said safety control means at certain time intervals to interrupt, for testing purposes, the continuous excitation of said safety relay, said safety relay forming said control circuit sending a confirmation signal to said microprocessor to signal normal operation.

8. A safety control circuit according to claim 1, wherein said at least three relay contact switches have fully restricted guidance defined by any of each of said three relay contacts being fused together determining the state of switching of all remaining relay contact switches not fused together.

* * * * *